United States Patent [19]

Jezic

[11] Patent Number: 5,021,288

[45] Date of Patent: Jun. 4, 1991

[54] MICROFIBERS OF SYNDIOTACTIC VINYL AROMATIC POLYMERS, NONWOVEN MATS OF THE MICROFIBERS

[75] Inventor: Zdravko P. Jezic, Lake Jackson, Mich.

[73] Assignee: The Dow Chemical Company, Midland, Mich.

[21] Appl. No.: 460,701

[22] Filed: Jan. 4, 1990

[51] Int. Cl.[5] ..... D03D 3/00

[52] U.S. Cl. ..... 428/224; 428/221; 428/288; 428/364; 428/903

[58] Field of Search ..... 428/221, 224, 288, 903, 428/264

[56] References Cited

U.S. PATENT DOCUMENTS 2,411,660 11/1946 Manning .
3,704,198 11/1972 Prentice .
3,849,241 11/1974 Butin et al. .
4,041,203 8/1977 Brock et al. .
4,196,245 4/1980 Kitson et al. .
4,302,495 11/1981 Marra .

OTHER PUBLICATIONS

*A Macroscopic View of the Melt-Blowing Process for Producing Microfibers,* Shambaugh, R. L., 1988 American Chemical Society, pp. 2363-2372.

*Primary Examiner*—James J. Bell
*Attorney, Agent, or Firm*—Douglas N. Deline

[57] ABSTRACT

A melt-blowing process for producing a fiber preferably a microfiber of a syndiotactic vinyl aromatic polymer, which comprises supplying a vinyl aromatic polymer having a high degree of syndiotacticity in a molten form from at least one orifice of a nozzle into a gas stream which attenuates the molten polymer into microfibers. Such microfibers are particularly useful in the field of high temperature filtration, coalescing and insulation.

3 Claims, 1 Drawing Sheet

MICROFIBERS OF SYNDIOTACTIC VINYL AROMATIC POLYMERS, NONWOVEN MATS OF THE MICROFIBERS

BACKGROUND OF THE INVENTION

The present invention relates to microfibers of syndiotactic vinyl aromatic polymers and nonwoven mats of the microfibers particularly useful in the field of filtration and insulation. The present invention also relates to a melt-blowing process for the production of the microfibers and the nonwoven mats.

Various melt-blowing processes for producing nonwoven mats or webs of microfibers have been described heretofore in patents and literature.

U.S. Pat. No. 2,411,660 describes a melt-blowing process for the manufacture of nonwoven fabrics from plastics for abrading, scouring, filtering, etc. U.S. Pat. No. 3,849,241 discloses a process for producing a melt-blown nonwoven mat wherein a fiber-forming thermoplastic polymer resin having a specific initial intrinsic viscosity is subjected to degradation in the presence of a free radical source compound. Several melt-blowing processes for the production of a nonwoven thermoplastic fabric or a composite thereof are taught in U.S. Pat. Nos. 4,041,203, 4,196,245 and 4,302,495. R. L. Shambaugh discussed several factors of a melt-blowing process using dimensional analysis in "A Macroscopic View of the Melt-Blowing Process for Producing Microfibers", Ind. Eng. Chem. Res., Vol. 27, No. 12, 2363–72 (1988).

On the other hand, syndiotactic polymers of vinyl aromatic monomers have recently been developed. U.S. Pat. No. 4,680,353 discloses a polymerization of syndiotactic polystyrene using certain titanium based Kaminsky-Sinn catalysts. In U.S. Pat. No. 4,774,301 a similar process employing a zirconium containing Kaminsky-Sinn catalyst is disclosed. In EP's 271,874, 271,875 and 272,584 further description of suitable Kaminsky-Sinn catalysts is provided. U.S. patent application No. 223,474 filed July 22, 1988 and EP 291,915 teach a process for producing fibers of syndiotactic polystyrene using a melt-spinning process which clearly differs from the melt-blowing process.

The aforementioned patents regarding a melt-blowing process indicate that a broad range of plastic materials may be used for producing nonwoven mats of microfibers U.S. Pat. No. 2,411,660 states that a great variety of plastics may be used, such as vinylidene chloride, polystyrene, polyphenylenesulphide, polyvinyl alcohol, polyvinyl acetate, methyl methacrylate, polymeric amide, copolymer of vinyl chloride and vinyl acetate, latex compositions, cellulosic and petroleum derivatives, protein-base materials, glass, etc. U.S. Pat. No. 4,041,203 describes that among the many useful thermoplastic polymers, polyolefins such as polypropylene and polyethylene, polyamides, polyesters such as polyethylene terephthalate, and thermoplastic elastomers such as polyurethanes are anticipated to find the most wide spread use in the preparation of the materials described herein (nonwoven thermoplastic fabrics of microfibers). However, it has been discovered that certain polymers, particularly certain crystalline polymers, are difficult to melt-blow. For example, it is found that crystalline polyamide is not suitable for melt-blowing because of a lack of suitable melt viscosity and melt elasticity properties. If a melt-blowing process is carried out at high temperature at which the crystalline polyamide can be processed, the thermal degradation of the molten polymer will readily occur. In addition suitable conditions of extrusion rate and air velocity cannot be attained to avoid the twin problems of fiber attenuation and breakage or slub formation, i.e., formation of globular agglomerates of polymer.

Currently, filters comprising fibers of polytetrafluoroethylene, polyester, polyimide or glass are used in high temperature filtration of corrosive media such as acids, alkali, chlorine cell effluent, flue gas, etc. However, nearly all of the existing materials have proven unsatisfactory for extremely demanding, high temperature filtration applications. In particular, filtration media comprising the polyester fibers lack sufficient hydrolytic stability and chemical resistance under actual operating conditions, and glass fibers are readily attacked by alkali.

It would be desirable if there were provided a microfiber and a nonwoven mat, fabric, web, or similar structure prepared therefrom comprising a vinyl aromatic polymer having a high degree of syndiotacticity and crystalline structure, which have good hydrolytic stability, good chemical resistance and good high temperature resistance.

It would also be desirable if there were provided a melt-blowing process for producing a fiber, preferably a microfiber or a nonwoven mat therefrom, comprising a vinyl aromatic polymer having a high degree of syndiotacticity and crystalline structure.

SUMMARY OF THE INVENTION

Figure 1:
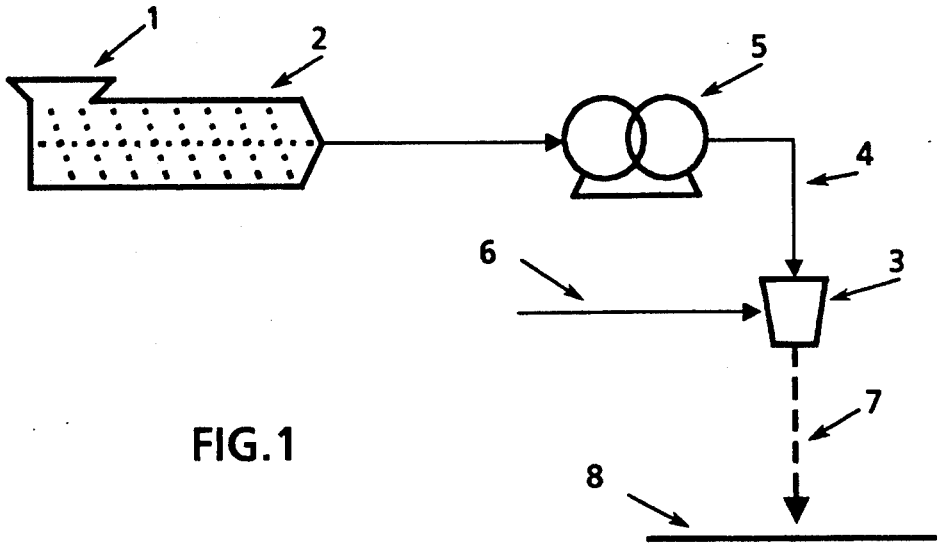
FIG. 1 discloses a schematic diagram of an overall melt-blowing process of a preferred embodiment of the present invention.

According to the present invention there is now provided a melt-blowing process for producing a fiber, preferably a microfiber of a vinyl aromatic polymer having a high degree of syndiotacticity, which comprises supplying a vinyl aromatic polymer having a high degree of syndiotacticity in a molten form from at least one orifice of a nozzle into a gas stream supplied to an area adjacent to the orifice which attenuates the molten polymer into fibers.

Another aspect of the present invention relates to a microfiber of a vinyl aromatic polymer having a high degree of syndiotacticity which has an average diameter of not greater than 400 microns, preferably 0.5 to 50 microns.

A final aspect of the present invention relates to a nonwoven mat or web comprising a random or oriented juxtaposition of a multitude of the foregoing microfibers. Orientation is readily obtained by controlling the laydown of fibers emerging from the spinpack according to known techniques.

The microfibers and the nonwoven mat of the present invention are particularly useful in high temperature filtration of corrosive media such as flue gas, hydraulic oil, and coalescing of fluids under hot and corrosive environments, especially in the presence of acids and bases.

DETAILED DESCRIPTION OF THE INVENTION

As used herein, the term "microfiber" refers to fibers having a diameter smaller than that of melt-spun fibers of the corresponding polymer. The microfibers of the present invention suitably have an average diameter not greater than 400 microns, more suitably from 0.5 to 50 microns, and most suitably from 1 to 10 microns.

As used herein, the term "syndiotactic" refers to polymers having a stereo regular structure of greater than 50 percent, preferably greater than 70 percent, and most preferably greater than 80 percent syndiotactic of a racemic triad as determined by C13 nuclear magnetic resonance spectroscopy.

Any known melt-blowing process may be used in the present invention. For example, melt-blowing processes which can be used in the present invention are well described in U.S. Pat. Nos. 3,849,241; 4,041,203; 4,196,245; and 4,302,495, the teachings of which are herein incorporated in their entirety by reference thereto. The typical melt-blowing process comprises continuously extruding a starting polymer in a molten form through orifices of a die nozzle in order to form discrete filaments. The filaments are drawn aerodynamically using a gas stream supplied to an area adjacent to the orifices of the die nozzle, which gas stream attenuates the molten polymer into fibers, preferably microfibers. The continuous filaments are deposited in a substantially random manner onto a carrier belt or the like to form fibers or a mat of substantially continuous and randomly arranged fibers.

Suitable vinyl aromatic polymers having high degree of syndiotacticity which can be used in the present invention, are those prepared from monomers represented by the formula:

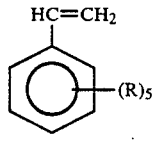

wherein each R is independently hydrogen; an aliphatic, cycloaliphatic or aromatic hydrocarbon group having from 1 to 10, more suitably from 1 to 6, most suitably from 1 to 4, carbon atoms; or a halogen atom.

Examples of preferred polymers are polystyrene, poly(halogenated styrene) such as polychlorostyrene, poly(alkylstyrene) such as poly(n-butyl styrene) and poly(p-vinyl toluene), etc. having the aforementioned syndiotactic structure. Syndiotactic polystyrene is especially suitable. The preparation method of vinyl aromatic polymers having a high degree of syndiotacticity are well described in, for example, U.S. Pat. Nos. 4,680,353 and 4,774,301, the teachings of which are herein incorporated in their entirety by reference thereto.

Highly desirable syndiotactic vinyl aromatic polymers which can be employed in the present invention suitably have a viscosity ranging from 50 to 1500 poise, more suitably from 100 to 1,000 poise, most suitably from 200 to 500 poise (measured at processing temperature). Preferably the molecular weight of the polymer ranges from 50,000 to 750,000, more preferably from 80,000 to 500,000, most preferably from 100 to 300,000 (determined by high temperature size exclusion chromatography). To obtain uniform melt-blown products of better uniformity, a polymer having narrow molecular weight distribution (Mw/Mn) may be selected. The molecular weight distribution of the polymer is preferably within the range of from 1.8 to 8.0, more preferably from 2.0 to 5.0, most preferably from 2.2 to 3.0.

Turning now to FIG. 1, there is illustrated one preferred manner of producing microfibers or a nonwoven mat of microfibers. In FIG. 1, a syndiotactic vinyl aromatic polymer resin (such as syndiotactic polystyrene), in the form of powders or pellets, is introduced into a hopper, 1, connected to an extruder, 2. The syndiotactic polystyrene is melted in the extruder, 2, and supplied to a spinpack, 3, through a molten polymer supplying line, 4, by a pump, 5. The term "spinpack" refers to an assembly comprising a die nozzle having at least one orifice for a molten polymer and having at least one gas slot for melt-blowing the molten polymer, and a heating means for keeping the die nozzle at a prescribed, uniform temperature. The extruder 2, the spinpack 3, and the molten polymer supplying line 4 may have a heating means for melting a polymer or for keeping a polymer in a molten state. The heating means is preferably controlled electrically or via a heat transfer fluid system.

A gas stream such as hot air, nitrogen, etc. is introduced into the spinpack, 3, through a gas stream supplying line, 6. In the spinpack, 3, the molten polymer is forced out of an orifice of a nozzle of the spinpack, 3, into the co-current gas stream which attenuates the resin into fibers, 7. The fibers, 7, are collected on a collecting device, 8, in the form of a nonwoven mat. The collecting device may be in the form of a drum or a belt made from a porous material or screening which can collect the microfibers, 7, or the nonwoven mat. The nonwoven may be prepared in a continuous or discontinuous manner and further operations such as compaction, stretching, calendering, embossing, twisting, winding etc. may be performed to further alter or collect the resulting mat. In the practice of the present invention, a plurality of the spinpacks, 3, can be employed. If necessary, i.e., in a case of nozzle blockage, the excess of the molten polymer could be withdrawn from the molten resin supplying line, 4, to an overflow container (not shown).

Figure 2:
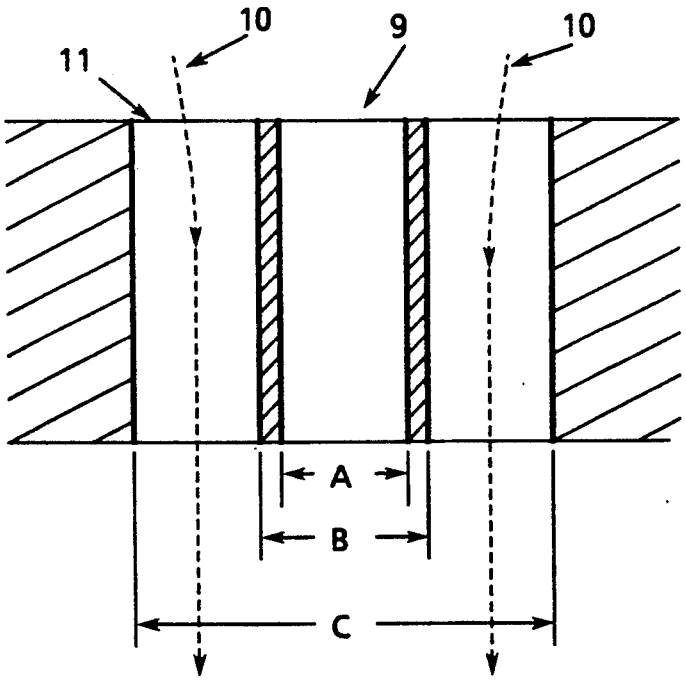
FIG. 2 discloses in cross section the nozzle of the melt blowing means, (spinpack) which can be used in one embodiment of the melt-blowing process of the present invention.

The mechanism of formation of microfibers is seen more clearly in FIG. 2 which shows an enlarged detail of the cross sectional view of the nozzle of the spinpack, 3. In FIG. 2, the molten polymer is forced out of a circular orifice of a nozzle (die opening), 9, having inner diameter A and outer diameter B, and into the gas stream, 10, which is passed through circular gas slot, 11, having a diameter C. Usually, the spinpack, 3, is provided with a plurality of the orifices, 9. As is apparent from FIG. 2, a syndiotactic polymer in a molten form is supplied from the orifice, 9, into the gas stream, 10, supplied to an area adjacent to the orifice, 9, which attenuates the molten polymer into the microfibers, 7.

The characteristics of microfibers or nonwoven mats produced by the melt-blowing process of the present invention will vary depending upon the various process conditions used. Those condition include, for example, gas flow rates: kinds of gas used as a gas stream; properties of a polymer supplied resin (polymer) flow rates; distance between the collecting device and orifice of a spinpack: the diameter and shape of an orifice: the size of the gas slot: and the temperatures of the polymer, spinpack and gas stream. Of these, the temperature of the polymer and gas supplied, the gas flow rates, the resin flow rate, and the distance between the collecting device and the orifice of the nozzle greatly affect the properties of the final products.

The processing temperature, i.e., temperature of a polymer processed in a molten state is above the melting point of the polymer, i.e., 270° C. for syndiotactic polystyrene, so that the viscosity of the polymer is within the range mentioned above. The processing temperature may finally be controlled by a heating means provided to the spinpack. A preferred temperature range is from greater than 270° to 400° C., more preferably from 285° to 315° C., most preferably from 295° to 305° C.

In the melt-blowing process of the present invention, the syndiotactic polymer in a molten form can be readily attenuated to fibers having diameters of 0.1 to 400 microns. It is also possible to produce fibers having diameters of greater than 400 microns. As gas flow rates increase for a selected resin flow rate of a polymer, the average diameter of the resultant fibers decreases, but the number of fiber breaks may also increase resulting in the formation of short microfibers which are not as suitable for preparing mats having good physical strength, and coarse "shot" which comprises globs or slubs of polymer having a diameter at least several times that of the average diameter size of the fibers. Lower gas velocities result in larger diameter fibers. Preferable gas flow rates (measured at the nozzle) range from 200 to 700 m/sec, more suitably from 400 to 600 m/sec, most suitably from 440 to 560 m/sec. At gas flow rates of from 400 to 600, the fibers are essentially continuous with minimum fiber breaks. Fibers produced in this gas flow rate range have diameters of less than 10 microns, and preferably less than 5 microns.

Suitable gasses used in the present invention include, for example, air, nitrogen, helium, argon and mixtures thereof with air and nitrogen being most common. A preferred gas stream temperature is from 425° to 500° C., more preferably from 440° to 490° C., most preferably from 455° to 475° C.

In the present invention, commercially useful resin flow (throughput) rates can be used. Suitable resin flow rates at each nozzle range from 0.1 to 10, more suitably from 0.5 to 5, most suitably from 1 to 3 grams per minute per orifice.

The resin flow rate, gas flow rate and viscosity of the polymer are controlled and correlated in accordance with the present invention.

The distance of the collecting device from the orifice of the nozzle may be altered to change the physical properties of the resulting mat according to techniques known in the art. In the present process variation in mat physical integrity may be obtained since the self-bonding ability of the fibers decreases with increasing distance from the orifice. At prescribed distances, the fibers have sufficient self-bonding ability to make a high strength web or mat. At longer distances than the above, a final web product in the form of physically entangled but not adhered fibers can be obtained. Suitable distances to obtain the foregoing results will vary dependent on the other factors such as a gas flow rate, resin flow rate, and surrounding temperature. The preferred distance to make nonwoven mats is from about 15 to 60 cm, more preferably from 25 to 35 cm.

In accordance with the present invention, the tensile strength of nonwoven mats is increased by fuse-bonding the nonwoven mat by exposing the same to temperatures greater than 270° C., optionally while compressing the mat sufficiently to prevent shrinkage of the fibers in the mat. This type of fuse-bonding process has been previously described for other polymeric fibers in U.S. Pat. No. 3,704,198.

The web or mat of the present invention can be utilized to prepare composites or laminates according to the techniques described in U.S. Pat. Nos. 4,041,203; 4,196,245; and 4,302,495.

The nonwoven mats of the present invention are particularly useful in high temperature filtration of corrosive media such as flue gas (i.e., as bag house filters to remove particulates), acids and hydraulic oil, as coalescing media, and in other applications requiring thermal and chemical stability. The nonwoven mats of the present invention have high insulating value, high cover per unit weight, and high surface area per unit weight. Due to high orientation of microfibers in axial direction, randomization and proper thermal bonding the nonwoven mats also have high strength per unit weight. The nonwoven mats may also be compacted and used as battery separators. The nonwoven mats can also be used in any field where nonwoven mats of conventional construction have been used. Examples include uses as reinforcing liners for linoleum, gasketing, etc.

Having described the invention the following examples are provided as further illustrative and are not to be construed as limiting.

EXAMPLES 1-5

Nonwoven mats of melt-blown microfibers were prepared in accordance with a process as shown in FIG. 1 except that excess molten polymer was withdrawn from a molten polymer supplying line, 4, to an overflow container. A ¾" (1.9 cm) extruder (L/D=20; compression ratio=1:3) was used. A spinpack was employed having a nozzle with one orifice surrounded by a circular gas slot, 11, as shown in FIG. 2 wherein the inner of the orifice, A, was 0.0533 cm (0.0210 inches); the outer diameter of the orifice, B, was 0.0826 cm (0.0325 inches): and the diameter of the circular gas slot, C, was 0.1656 cm (0.0652 inches). A distance bet the orifice and the collecting device 8 was 3.25 cm. The time required for a polymer to pass through the from the feeding hopper on the extruder to the collecting device below the spinpack was 15 minutes.

Syndiotactic polystyrene having an average molecular weight (Mw) of 166,000 and a molecular weight distribution (Mw/Mn) of 2.72 was added to the extruder hopper and melted. The melt-blowing process was carried out using the process conditions as indicated in Table 1. Air was used as a gas stream in Examples 1, 2 and 5, and nitrogen in Examples 3 and 4.

The soft, fluffy nonwoven mats of microfibers with a minimum of slubs or shot were obtained.

The average diameter, molecular weight and molecular weight distribution of microfibers in the nonwoven mats obtained are as shown in Table 1.

TABLE 1

| Example No. | Gas Stream Temperature at Nozzle (°C.) | Polymer Temperature at Nozzle (°C.) | Polymer Flow Rate at Nozzle (g/min) | Nominal Gas Flow Rate at Nozzle (m/sec)** | Mw (× 1000) | Mn (× 1000) | Mw/Mn | Average Diameter of Microfibers (μm) |
|---|---|---|---|---|---|---|---|---|
| 1 | 483 | 298 | 0.358 | 441 | 80 | 32.9 | 2.44 | — |
| 2 | 491 | 298 | 0.388 | 552 | 75.1 | 28.5 | 2.64 | 2.01 |
| 3* | 492 | 298 | 0.384 | 552 | 74.8 | 27.3 | 2.74 | 2.45 |
| 4* | 480 | 297 | 0.390 | 441 | 80.5 | 33.3 | 2.41 | — |
| 5 | 480 | 297 | 0.330 | 441 | 79.8 | 29.0 | 2.75 | — |

*$N_2$ was used for attenuation instead of air.
**Nominal Gas Flow Rates were calculated assuming polytropic conditions (neither adiabatic nor isothermal).

What is claimed is:

1. A microfiber of a vinyl aromatic polymer having a stereoregularity of greater than 50 percent syndiotactic and a crystalline structure, and having an average diameter of from 0.1 to 400 microns.

2. A microfiber according to claim 1 wherein the vinyl aromatic polymer is syndiotactic polystyrene having a molecular weight (Mw) of from 50,000 to 750,000 and a molecular weight distribution (Mw/Mn) of from 1.8 to 8.0.

3. A nonwoven mat of microfibers of a syndiotactic vinyl aromatic polymer comprising microfibers of claim 1.

* * * * *

UNITED STATES PATENT AND TRADEMARK OFFICE

CERTIFICATE OF CORRECTION

PATENT NO. : 5,021,288

DATED : June 4, 1991

INVENTOR(S) : Zdravko Jezic

It is certified that error appears in the above-identified patent and that said Letters Patent is hereby corrected as shown below:

Title page, item [75] Inventor: "Lake Jackson, Mich." should correctly read --Lake Jackson, Texas--.

Signed and Sealed this

Eighth Day of December, 1992

*Attest:*

DOUGLAS B. COMER

*Attesting Officer*

*Acting Commissioner of Patents and Trademarks*